US007465211B2

(12) United States Patent
Lai

(10) Patent No.: US 7,465,211 B2
(45) Date of Patent: Dec. 16, 2008

(54) COMBINATIONAL STORAGE DECORATION STRUCTURE

(76) Inventor: Chi-Shih Lai, 1F., No. 91, Lane 259, Szu Wei Rd., Panchiao, Taipei Hsien (TW)

( * ) Notice: Subject to any disclaimer, the term of this patent is extended or adjusted under 35 U.S.C. 154(b) by 178 days.

(21) Appl. No.: 11/705,088

(22) Filed: Feb. 12, 2007

(65) Prior Publication Data

US 2008/0192469 A1 Aug. 14, 2008

(51) Int. Cl.
*A63H 3/16* (2006.01)
*F21V 1/06* (2006.01)

(52) U.S. Cl. ..... 446/69; 206/585; 362/252; 362/352; 362/431; 362/808; 446/73; 446/75

(58) Field of Classification Search ..... 362/252, 362/808, 806, 352; 206/457, 585; 446/69, 446/73, 75, 97, 487
See application file for complete search history.

(56) References Cited

U.S. PATENT DOCUMENTS 2,927,397 A * 3/1960 Wilson ..... 446/73
3,520,078 A * 7/1970 Klamer ..... 446/73
3,660,926 A * 5/1972 Lerner et al. ..... 446/73
5,814,380 A * 9/1998 Tamborello et al. ..... 428/9
6,506,094 B1 * 1/2003 Chang ..... 446/268
6,551,164 B1 * 4/2003 Motosko ..... 446/97
D489,100 S * 4/2004 Pino ..... D21/635
2005/0105288 A1 * 5/2005 Chen ..... 362/249

* cited by examiner

*Primary Examiner*—Jong-Suk (James) Lee
*Assistant Examiner*—Leah S Lovell
(74) *Attorney, Agent, or Firm*—Rosenberg, Klein & Lee

(57) ABSTRACT

The present invention discloses a combinational storable decoration structure that combines detachable components including a head portion, a shoulder portion, a body portion, a leg portion, and a hand portion into a decoration structure. The storing characteristic of the decoration structure allows users to store each detachable component into the body portion to form a cylindrical body so as to facilitate the storage and transportation of the decoration structure.

12 Claims, 9 Drawing Sheets

COMBINATIONAL STORAGE DECORATION STRUCTURE

BACKGROUND OF THE INVENTION

1. Field of the invention

The present invention relates to a decorative product, and more particularly to a combinational storable decoration structure.

2. Description of Related Art

In the past, various different models of decorative products have generally adopted an integral structure or a detachable structure. Although the integral decorative products can be produced and manufactured quickly, the characteristics of an integral structure have also given rise to issues of large volume and inconvenient storage and transportation.

On the other hand, a detachable decoration structure provides a do-it-yourself mechanism for users to assemble the decorative products, but such an arrangement still cannot solve the aforementioned issues of occupying a large space and making storage and transportation of the product inconvenient.

Although the detachable decoration structure can be dissembled and assembled, the detached components still cannot be stored inside one another, and thus this kind of design does not help much in solving the storage and transportation issues.

The present invention provides a structure to overcome the foregoing shortcomings. Furthermore, the present invention applies to general LED circuit technology as decoration structure.

SUMMARY OF THE INVENTION

In view of the foregoing shortcomings, the present invention provides a combinational storable decoration structure, wherein detachable components including a head portion, a shoulder portion, a body portion, a leg portion and a hand portion are combined into a decoration structure. With the storing characteristic of the decoration structure, users can store each detachable component into the body portion to form a cylindrical body, so as to achieve convenient storage and transportation.

The combinational storable decoration structure of the invention comprises a hollow head portion; a shoulder portion for supporting the head portion; a body portion for supporting the shoulder portion, which is stored into the head portion when the body portion is stored; at least one leg portion for supporting the body portion, which is stored into the head portion when the leg portion is stored; and a plurality of hand portions connected to the body portion, which are stored into the leg portion when the hand portions are stored.

If a user wants to combine and store the decoration structure, the user has to detach each detachable component from the decoration structure. The hand portion is placed into the leg portion, and the leg portion is fixed onto the base, the head portion is then placed up-side down into the body portion, and the shoulder portion is fixed onto a main body block. Finally, the leg portion connected onto the base together with the hand portion is placed inside the head portion in the body portion.

To make it easier for our examiner to understand the innovative features and technical content, we use preferred embodiments together with the attached drawings for the detailed description of the invention, but it should be pointed out that the attached drawings are provided for reference and description but not for limiting the present invention.

DETAILED DESCRIPTION OF THE PREFERRED EMBODIMENTS

Figure 1:
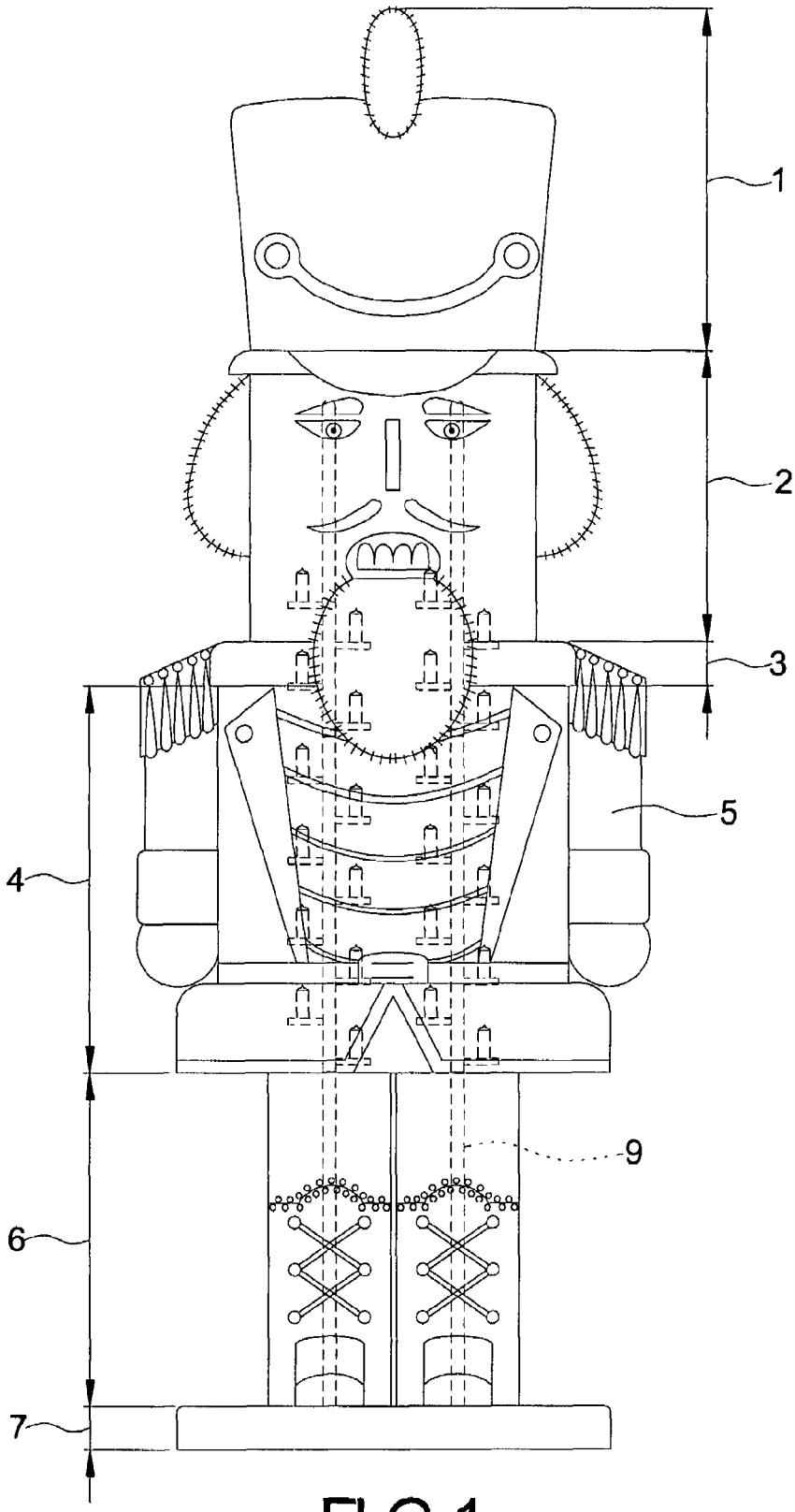
FIG. 1 is a front view of a combinational storable decoration structure of the present invention.
Figure 2:
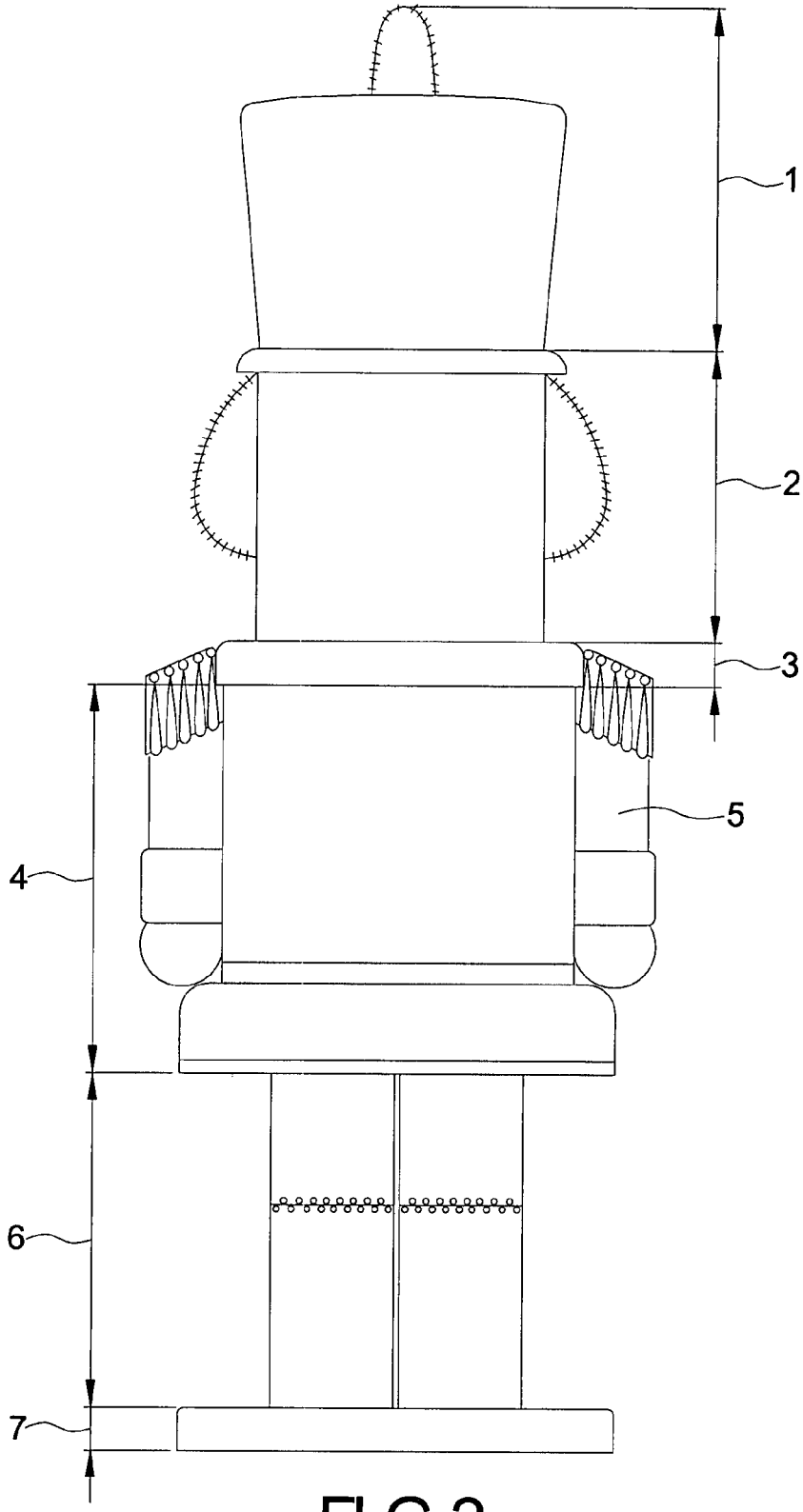
FIG. 2 is a rear view of a combinational storable decoration structure of the present invention.
Figure 3:
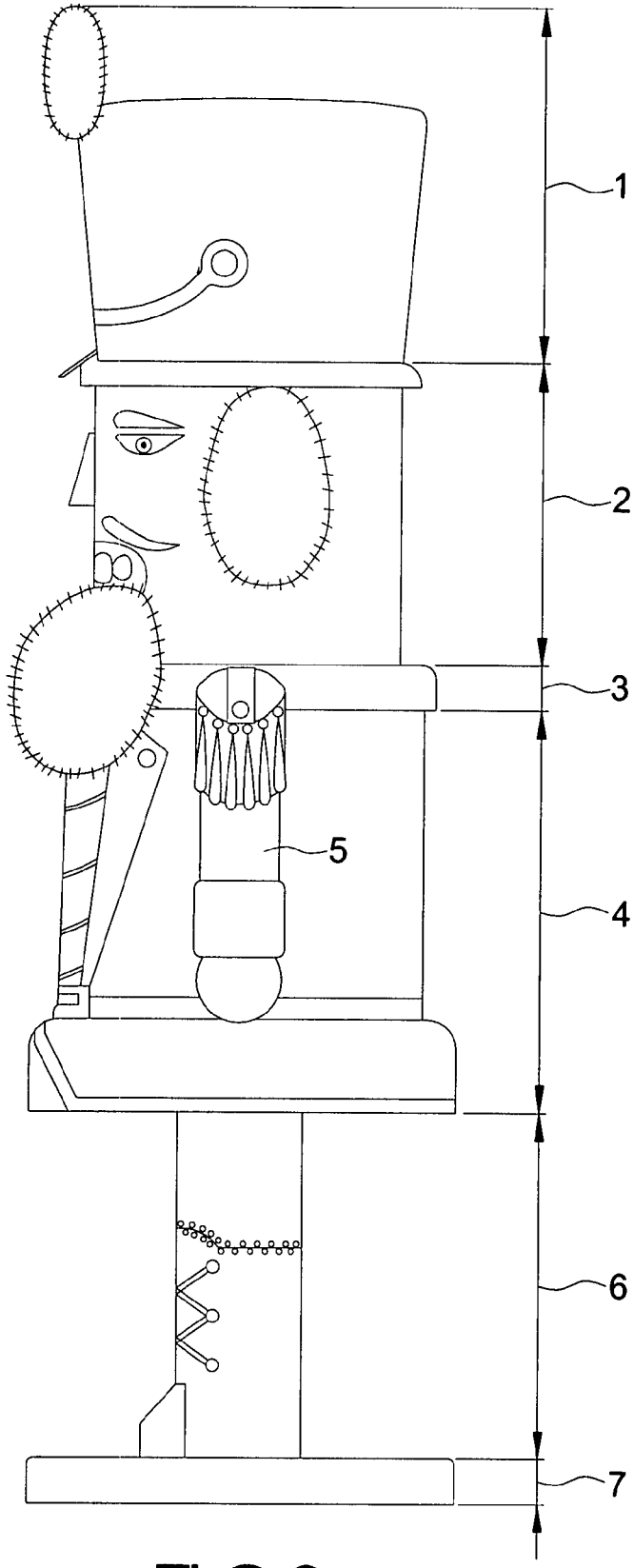
FIG. 3 is a side view of a combinational storable decoration structure of the present invention.
Figure 4:
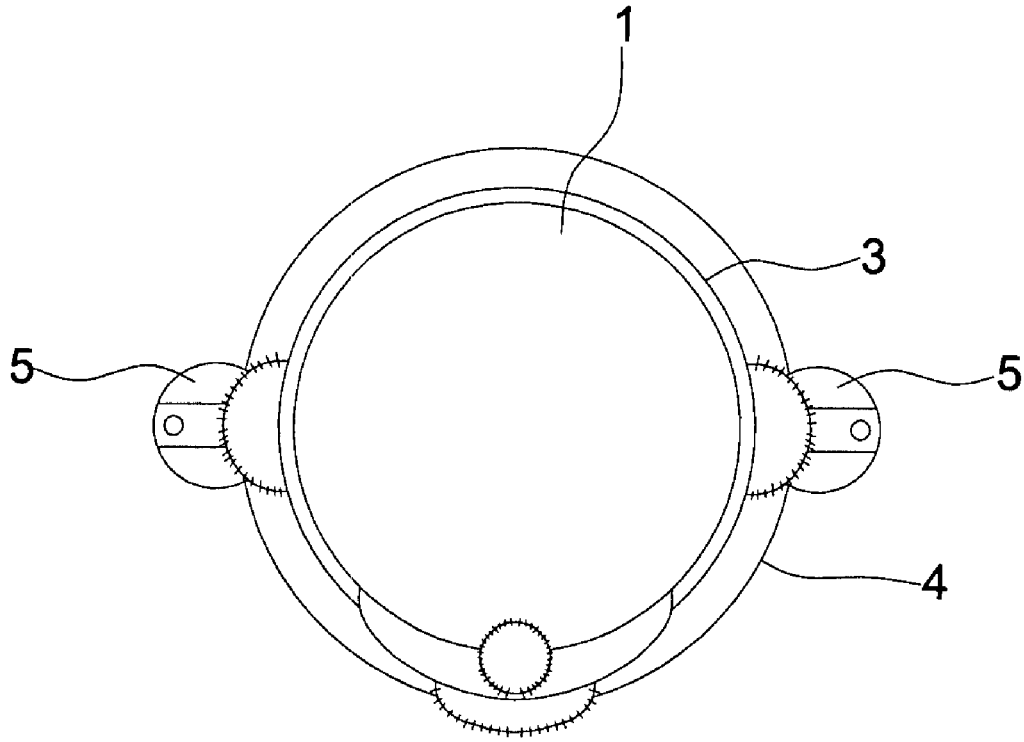
FIG. 4 is a top view of a combinational storable decoration structure of the present invention.

Referring to FIGS. 1 to 4 for a front view, a rear view, a side view and a top view of a combinational storable decoration structure in accordance with the present invention, the decoration structure comprises a cap decoration 1, a head portion 2, a shoulder portion 3, a body portion 4, a pair of hand portions 5, a pair of leg portions 6, a base 7 and a pair of circuit rods 9. The head portion 2 is used for supporting the cap decoration 1; the shoulder portion 3 is used for supporting the head portion 2; the body portion 4 is used for supporting the shoulder portion 3; the leg portions 6 are used for supporting the body portion 4; the base 7 is used for supporting the leg portions 6, and the hand portions 5 hang at both sides of the body portion 4 respectively.

In the decoration structure of the present invention, each component (including the cap decoration 1, the head portion 2, the shoulder portion 3, the body portion 4, the hand portions 5, the leg portions 6, the base 7 and the circuit rod 9) can be detached and assembled.

Figure 5:
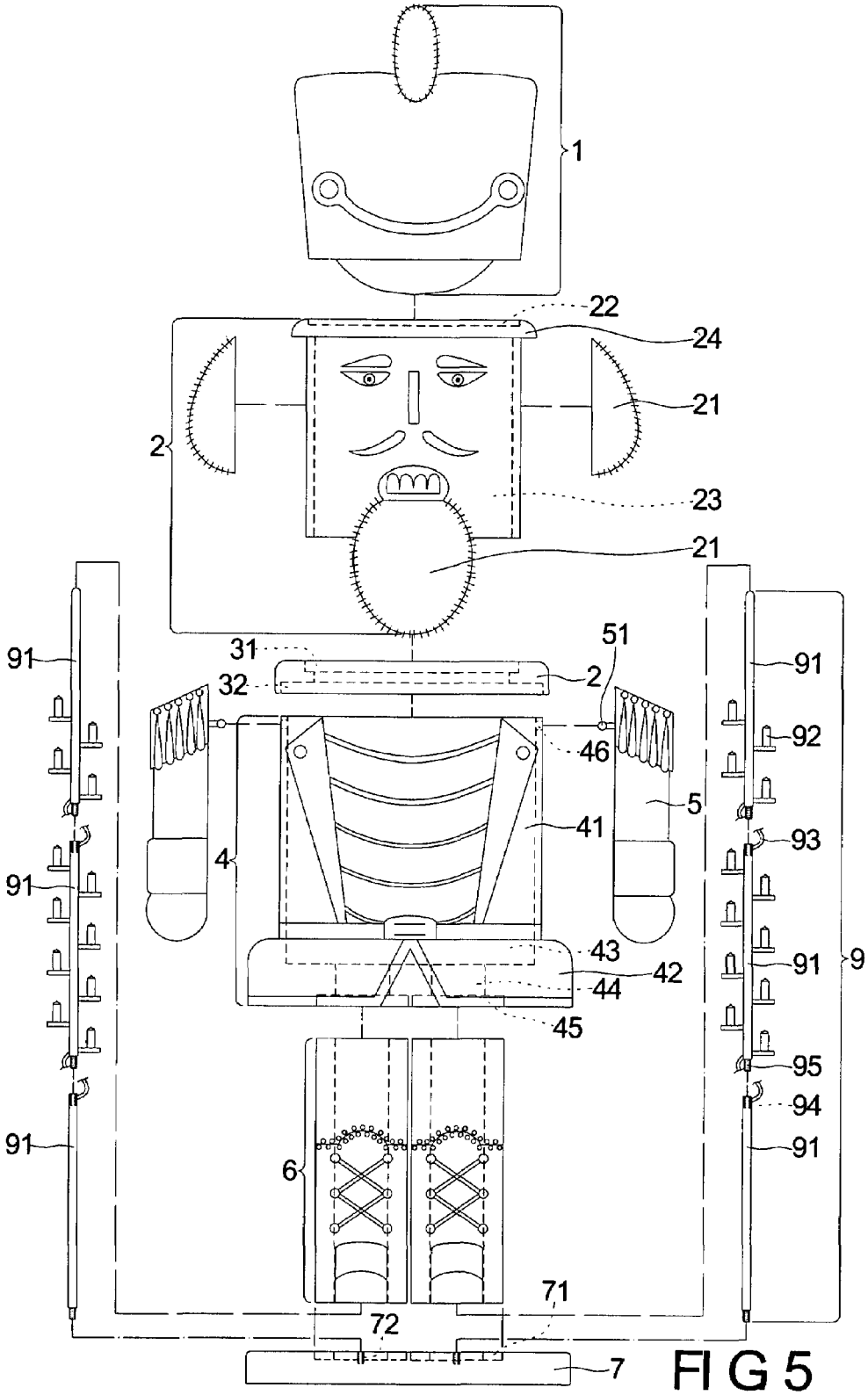
FIG. 5 is an exploded view of a combinational storable decoration structure of the present invention.

Referring to FIG. 5 for an exploded view of a combinational storable decoration structure of the present invention, the decoration structure comprises the following components. The head portion 2 is an inverted concave groove disposed on the structure and covered onto the shoulder portion 3. The head portion 2 comprises a plurality of head decorations 21, a fifth containing groove 22, a barrel-like portion 23, and a top portion 24. The head decorations 21 can be detachable components or fixed components, and if the head decorations 21 are detachable components, then a gluing or other adhering method can be used for connecting the head decorations with an external side of the barrel-like portion 23.

The width of the top portion 24 can be equal or unequal to the width of the barrel-like portion 23 depending on the user's preference, and the external side of the top portion 24 has a fifth containing groove 22 for containing the cap decoration 1. Therefore, the width and depth of the fifth containing groove 22 are designed on the basis of fixing the cap decoration 1.

The exterior of the barrel-like portion 23 can be painted with various figures or patterns so as to achieve an artistic look.

The shoulder portion 3 can be a hollow cylindrical body and comprises a fourth containing groove 31 and a fifth containing groove 32. The fourth containing groove 31 can be used for fixing and sheathing the barrel-like portion 23 of the head portion 2, and the fifth containing groove 32 can be used for fixing and sheathing the body portion 4. In addition, the fourth containing groove 31 can also be sheathed and fixed by the barrel-like portion 23 of the head portion 2, and the fifth containing groove (not shown in this embodiment) can also be fixed and sheathed by the body portion 4. The foregoing assembly can be set according to a user's requirements.

The body portion 4 is a concave groove comprised of a main body block 41 and a waist block 42. The main body block 41 is a hollow cylindrical body, and includes a first connecting component 46 disposed separately on both sides of the body block 41. The first connecting components 46 are provided for connecting the hand portions 5 having the corresponding second connecting components 51, such that the hand portions 5 can hang from both sides of the body portion 4. Therefore, the first connecting components 46 can be respectively connected with the second connecting components 51 by a screwing method, an insertion method, or a hanging method.

The waist block 42 comprises a third containing groove 43, a waist penetrating area 44, and a second containing groove 45. The hollow portions of the third containing groove 43 and the main body block 41 jointly form a containing space. The waist penetrating area 44 is disposed between the third containing groove 43 and the second containing groove 42 for penetrating the circuit rod 9 into the body portion 4. The second containing groove 45 is provided for fixing and sheathing the leg portion 6, wherein the leg portion 6 can be a hollow cylindrical body.

The base 7 comprises at least one base fixing groove 72 and at least one first containing groove 71. Each base fixing groove 72 is provided for fixing a circuit rod 9, and thus the base fixing groove 72 can be a threaded groove or any other appropriate form of groove. The circuit rod 9 is comprised of a plurality of detachable connecting rods 91, and each circuit rod 91 uses a set of corresponding third connecting components 94 and fourth connecting components 95 for the connection, and the circuit rod 9 comprises a plurality of lamps 92, and an electric wire 93 for connecting each lamp 92. Therefore, each connecting rod 91 can be connected by an insertion method or a screwing method. Each first containing groove 71 is provided for fixing the corresponding leg portion 6, and thus the first containing groove 71 can be a circular groove or any other appropriate form of groove.

In addition, the second containing groove 45, the waist penetrating area 44, the base fixing groove 72, the first containing groove 71, the circuit rods 9, the connecting rod 91 comprised of the circuit rods 9, and the number of lamps 92 on the circuit rod 9 can be designed according to a user's preference.

For instance, the decoration structure of the invention has two leg portions 6, which are two independent hollow cylindrical bodies constituting two leg portions 6, and each leg portion 6 is fixed between the corresponding first containing groove 71 and the second containing groove 45. The base 7 comprises two base fixing grooves 72 thereon, two waist penetrating areas 44 disposed in the waist block 42, so that the two circuit rods 9 can be fixed into the base fixing groove 72, and penetrate through the leg portion 6, the body portion 4 and the head portion 2.

Figure 6:
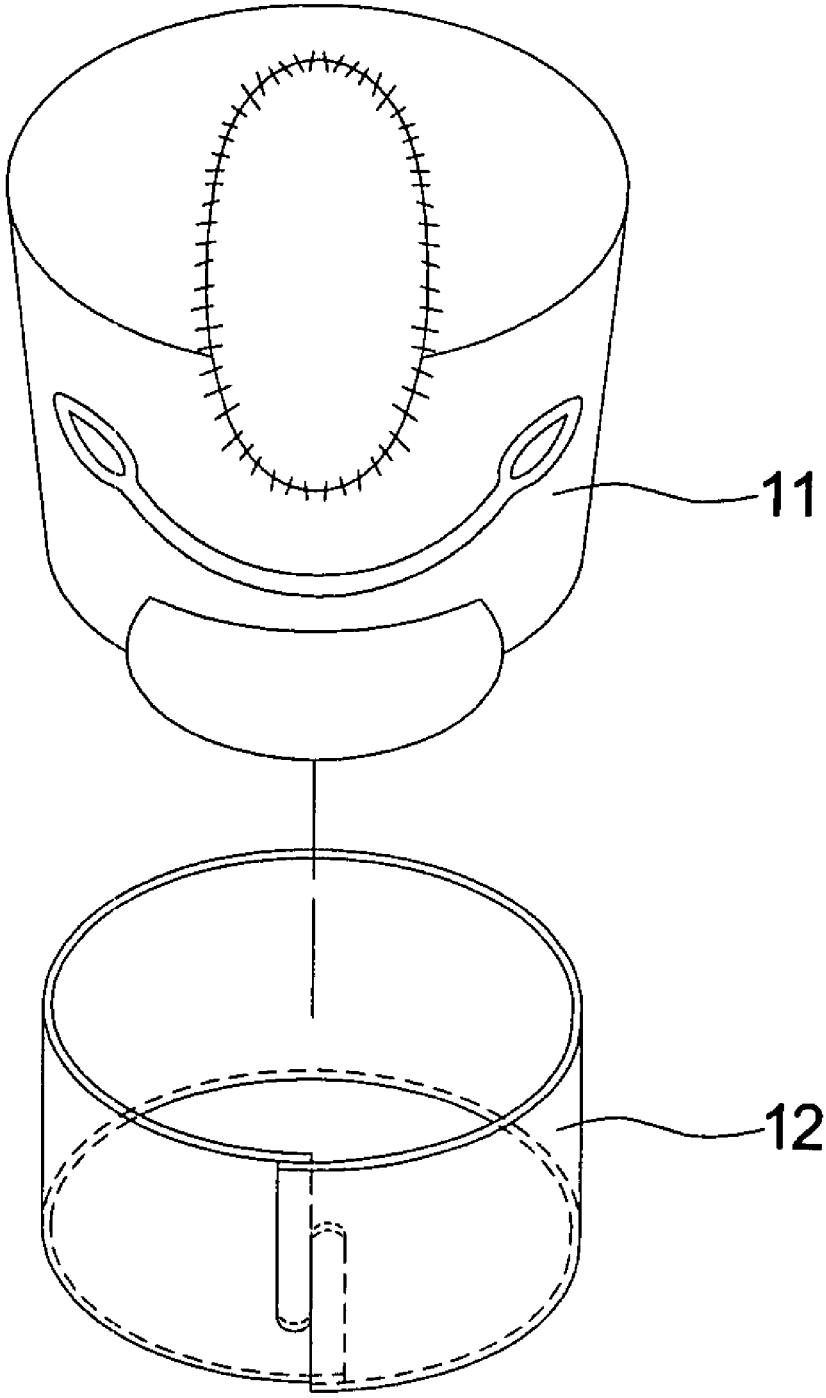
FIG. 6 is an exploded view of a cap decoration of a combinational storable decoration structure of the present invention.

In addition, the cap decoration 1 is a detachable component which can be dissembled into a soft hood 11 and an elastic plate 12 as shown in FIG. 6 (which is an exploded view of a cap decoration of a combinational storable decoration structure of the present invention). The elastic plate 12 can be a soft plastic sheet having a connecting portion disposed separately on both sides, so that a user can coil the elastic plate 12 into a cylindrical body by the connection portions, and the soft hood 11 can be covered onto the cylindrical body to form the cap decoration 1, and the soft hood 11 can be made of a fabric material.

Figure 7:
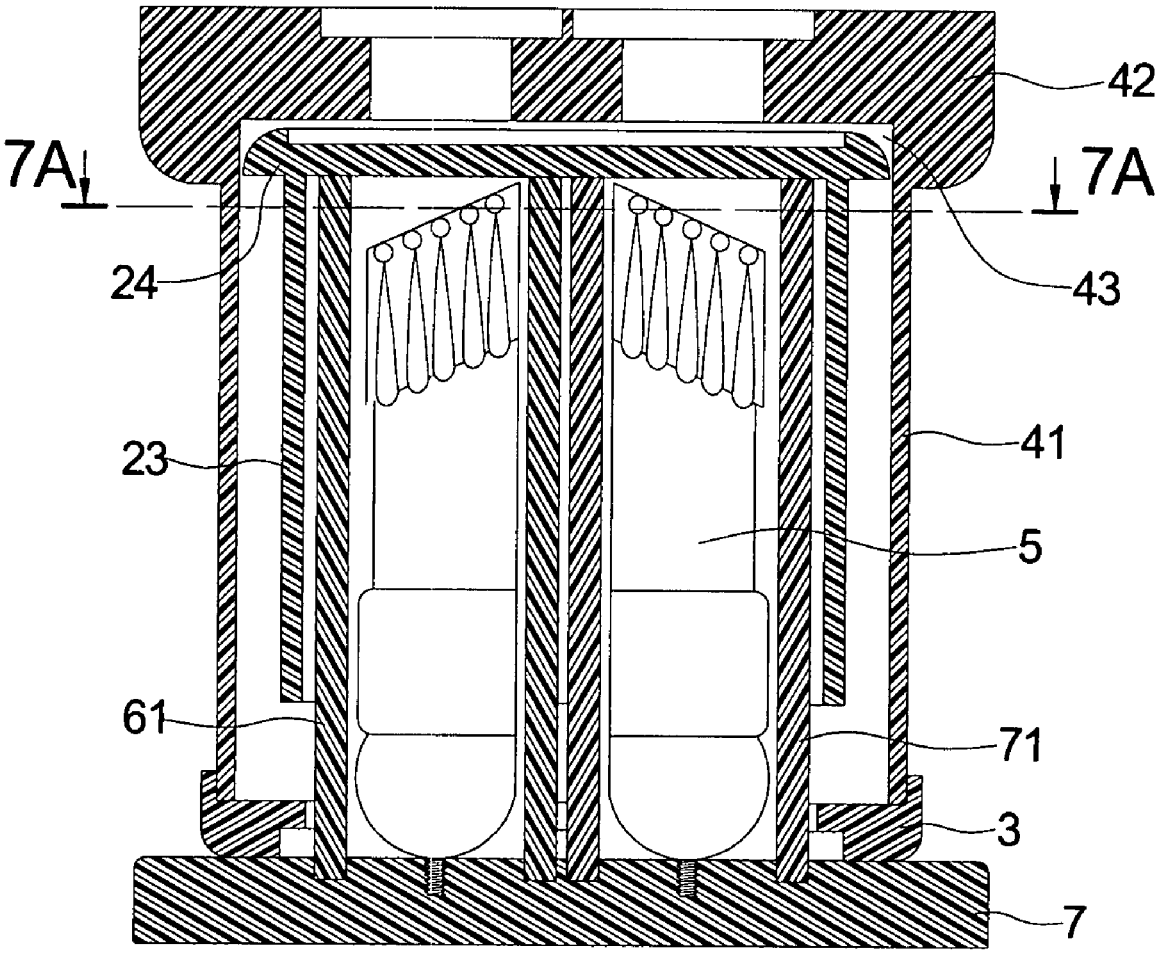
FIG. 7 is a schematic view of storing a combinational storable decoration structure of the present invention.

Referring to FIG. 7 a schematic view of storing a combinational storable decoration structure of the present invention is shown. A user has to detach each detachable component from the decoration structure first in order to store the combinational storable decoration structure, and then place the hand portion 5 into the leg portion 6, fix the leg portion 6 to the base 7, place the head portion 2 upside down into the body portion 4, and fix the shoulder portion 2 onto the main body block 41. Finally, the leg portions 6 (including the hand portions 5) connected to the base 7 together with the connecting rod 91 and its accessories (such as the elastic hood 11, elastic plate 12 and head decoration 21) into the head portion 2 of the body portion 4.

Figure 7A:
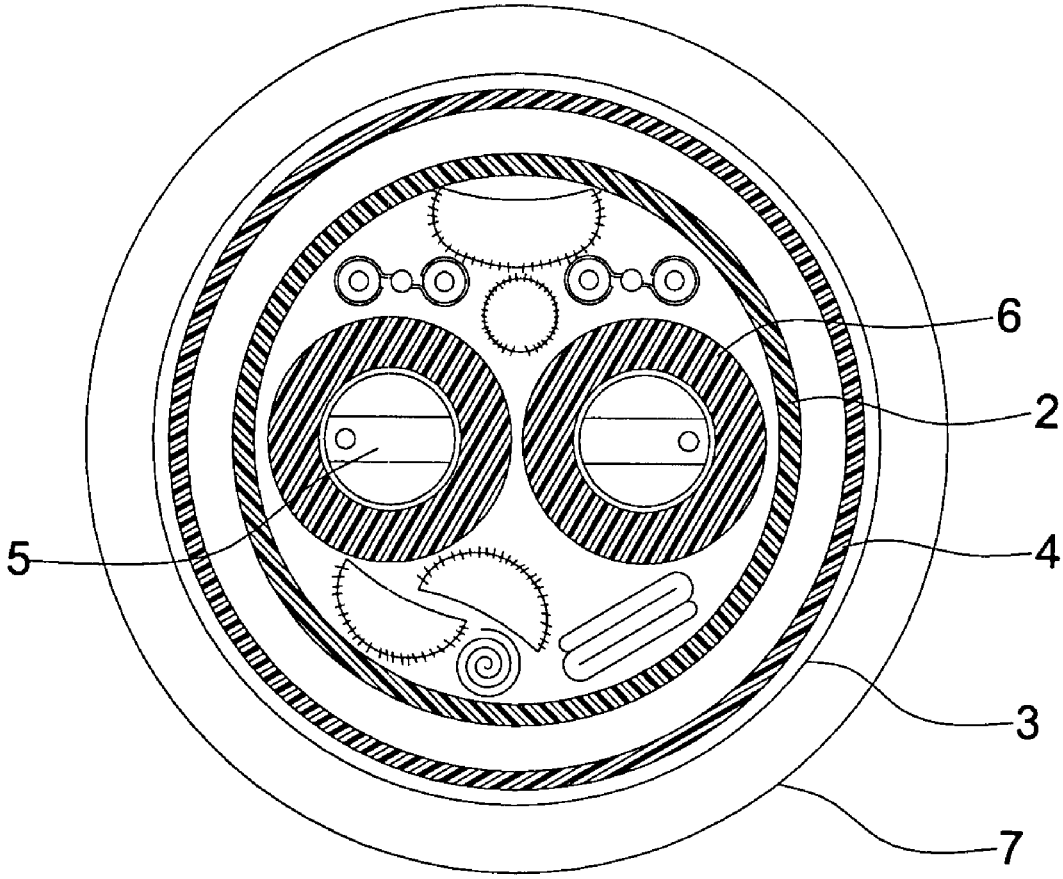
FIG. 7A is a cross-sectional top view of a combinational storable decoration structure of the present invention after the decoration structure is stored.

Please refer to FIG. 7A for a schematic top view of a combinational storable decoration structure of the present invention after the decoration structure has been stored. The decoration structure includes a lamp with various different light patterns, and thus a control circuit (not shown in the figure) is provided for illustrating the operation of the lamp 92 of the present invention. The lamp 92 is an LED lamp.

Figure 8:
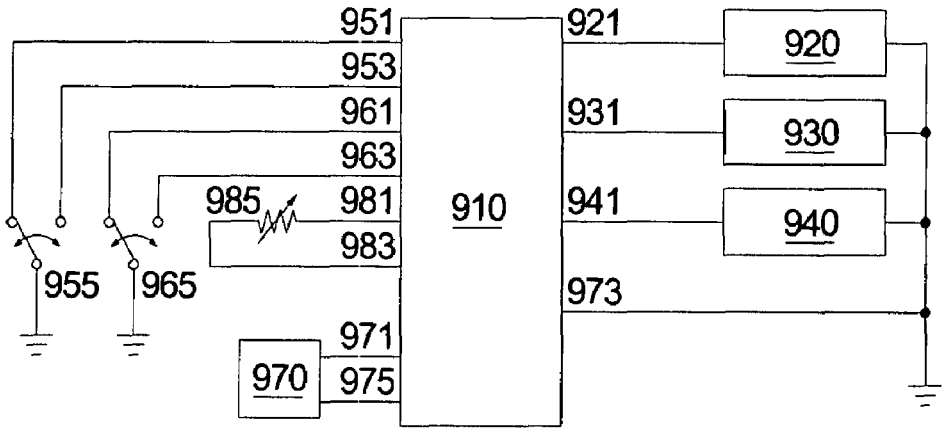
FIG. 8 is a schematic block diagram of an LED lamp control circuit of a decoration structure of the present invention.

Please refer to FIG. 8 for a schematic block diagram of an LED lamp control circuit of a decoration structure of the present invention. The control circuit of a serially connected light emitting lamp comprises a controller chip 910, a red lamp module 920, a blue lamp module 930, a green lamp module 940, a power supply unit 970, and a variable resistor 985 for controlling the operating time of the control circuit. The power supply unit 970 supplies a DC power from a pin 971 to the controller chip 910 so that the controller chip 910 can further control the operation sequence and light emission of the red lamp module 920, the blue lamp module 930, the green lamp module 940, and the pin 973 are all grounded.

The controller chip 910 controls the operation of the red lamp module 920 by the pin 921, the operation of the blue lamp module 930 by the pin 931 and the operation of the green lamp module 940 by the pin 941. The other end of each red lamp module 920, each blue lamp module 930 and each green lamp module 940 are all grounded.

The controller chip 910 further provides pins 951, 953 for controlling the switch point so that users can switch the operation circuit of the lamp 92 by a first switch 955. In other words, the color change for the operation of the lamp 92 can be switched among two or three colors in this embodiment. If the first switch 955 is switched to pin 951, the controller chip 910 will control the red lamp module 920, the blue lamp module 930, and the green lamp module 940 for a color change between two colors, but another lamp module will remain idle.

Similarly, pins 961, 963 are provided for the controller chip 910 to switch the operation mode of the lamp 92 (which is the changing mode of the lamp 92) by the second switch 965. For instance, if the pin 961 controls the alternately continuous blinking of the red lamp module 920, the blue lamp module 930 or the green lamp module 940, then the pin 963 will control the dimming of the red lamp module 920, the blue lamp module 930 or the green lamp module 940. If the second switch 965 is switched to the pin 961 to ground the pin 961, then the red lamp module 920, the blue lamp module 930 or the green lamp module 940 will produce a change of alternately continuous blinking according to the control of the controller chip 910. If the second switch 965 is switched to the pin 963 to ground the pin 963, the red lamp module 920, the blue lamp module 930, or the green lamp module 940 will dim according to the control of the controller chip 910.

Since the variable resistor 985 is connected to pins 981, 983, the controller chip 910 can control the operation time of the red lamp module 920, the blue lamp module 930, or the green lamp module 940 according to different resistances of a variable resistor 985.

Figure 9:
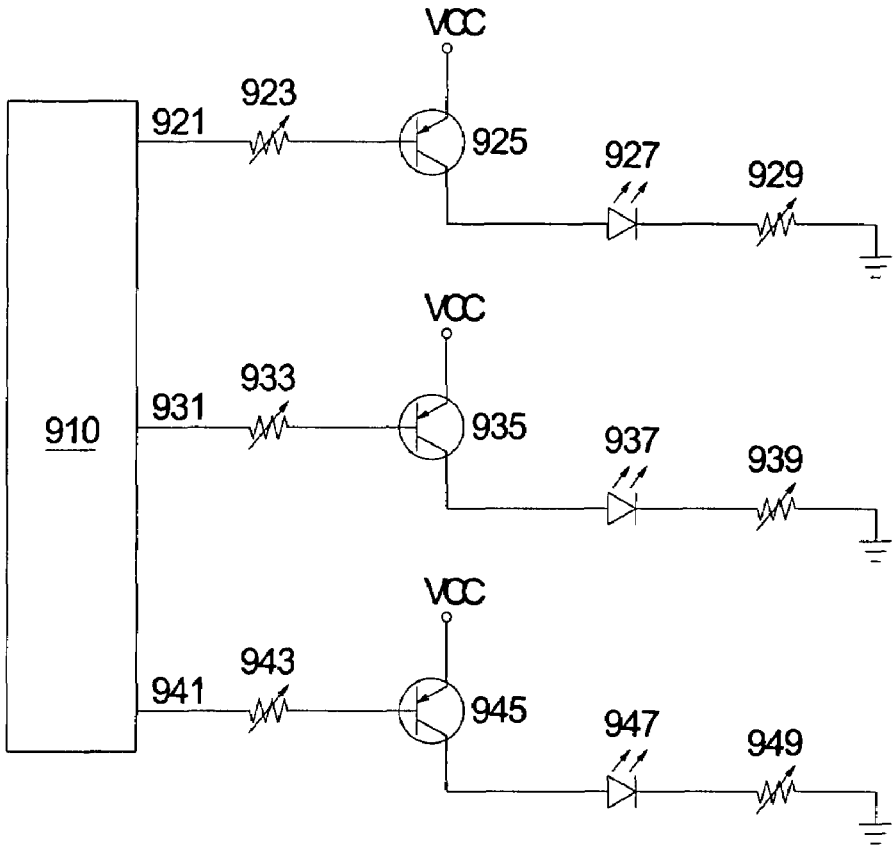
FIG. 9 is a schematic circuit diagram of an LED lamp circuit in a control circuit of a decoration structure of the present invention.

Please refer to FIG. 9 for a schematic circuit diagram of an LED lamp circuit in a control circuit of the red lamp module 920, the blue lamp module 930, or the green lamp module 940 of a decoration structure of the present invention.

The red lamp module 920 comprises a variable resistor 923, 929, a control transistor 925, and a red LED lamp 927. The blue lamp module 930 comprises variable resistors 933 and 939, a control transistor 935, and a blue LED lamp 937. The green lamp module 940 comprises a variable resistor 943, 949, a control transistor 945, and a green LED lamp 947.

If the first switch 955 is switched to the pin 951 to ground the pin 951, the controller chip 910 will control the operation of the red lamp module 920, blue lamp module 930 and green lamp module 940. Therefore, if the control transistor 925 is connected to a constant voltage source VCC, the controller chip 910 will be able to transmit a signal to the control transistor 925 through the pin 921, so that the control transistor 925 is electrically conducted to further conduct the red LED lamp 927 electrically. The switching direction of the first switch 955 can be preset.

Similarly, the controller chip 910 can transmit a signal to the control transistor 935 through the pin 931 to electrically conduct the control transistor 935 as well as the blue LED lamp 937. Alternatively, the controller chip 910 can transmit a signal to the control transistor 945 through the pin 941 to electrically conduct the control transistor 945 as well as the green LED lamp 947.

The operation time of each LED lamp is controlled by a variable resistor 985, and the change of operation of each LED lamp is controlled by the switch of the second switch 965.

Although the LED lamp module of the present invention uses one LED lamp, two variable resistors, and one control transistor to achieve the operation and timing of the LED lamp modules, the present invention is not limited to such arrangement. Any appropriate combination of resistors, transistors and LED lamps can be used for electrically conducting the transistor according to the signal provided by the controller chip 910, so as to further electrically conduct the LED lamps. Therefore, variable resistors 923, 929, 933, 939, 943, 949 can be substituted by a fixed resistor, and the quantity of red LED lamps 927, blue LED lamps 937, or green LED lamps 947 and each component of the LED lamp can be changed according to a user's requirements, and the colors of the LED lamps are not limited to those described here.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A combinational storable decoration structure, comprising:

a head portion;

a body portion, stored into the head portion when the body portion is stored;

a shoulder portion, for supporting the head portion and stored therein, the shoulder portion being supported by the body portion and being separate and distinct therefrom;

a leg portion, for supporting the body portion, stored into the head portion when the leg portion is stored; and a plurality of hand portions, removably connected to the body portion, stored into the leg portion when the hand portions are stored.

2. The combinational storable decoration structure of claim 1, further comprising a base, the base comprising at least one first containing groove for fixing the leg portion.

3. The combinational storable decoration structure of claim 2, wherein the base comprises at least one base fixing groove for fixing a corresponding circuit rod, and the circuit rod passes through the head portion, the body portion, and the head portion, and the circuit rod comprises a plurality of removable connecting rods, a plurality of lamps respectively fixed on the removable connecting rods, and an electric wire for connecting each lamp in series.

4. The combinational storable decoration structure of claim 3, further comprising at least one control circuit, wherein the control circuit uses a first switch to determine the quantity of lamps for the operation and a second switch to determine the operation mode of the lamps.

5. The combinational storable decoration structure of claim 1, wherein the body portion is a concave groove, and comprises a waist block and a hollow main body block, the waist block is provided for connecting the leg portion, and the main body block is provided for connecting the shoulder portion.

6. The combinational storable decoration structure of claim 5, wherein the waist block comprises at least one second containing groove for placing and fixing the leg portion.

7. The combinational storable decoration structure of claim 5, wherein the waist block comprises at least one waist penetrating area for passing a corresponding circuit rod.

8. The combinational storable decoration structure of claim 5, wherein the waist block comprises a third containing groove disposed in the body portion.

9. The combinational storable decoration structure of claim 1, wherein the shoulder portion is a hollow cylindrical body and comprises a fourth containing groove and a fifth containing groove, the fourth containing groove is provided for supporting the head portion, and the fifth containing groove is provided for connecting the body portion.

10. The combinational storable decoration structure of claim 1, wherein the head portion is an inverted concave groove, comprising a top portion and a barrel-like portion, an end of the barrel-like portion is connected to the top portion, and another end of the barrel-like portion is connected to the shoulder portion.

11. The combinational storable decoration structure of claim 10, wherein the top portion comprises a sixth containing groove, for supporting a cap decoration, the cap decoration comprises an elastic plate and a soft hood, both ends of the elastic plate separately include a connecting portion, and the connecting portions are connected with both ends of the elastic plate respectively to form a cylindrical body further sheathing the soft hood to the cylindrical body to form the cap decoration.

12. The combinational storable decoration structure of claim 1, further comprising a base for connecting the leg portions, wherein before the hand portions are placed into the leg portion, the head portion is placed upside down into the body portion, the shoulder portion is covered, and the body portion together with the head portion and the shoulder portion are placed upside down into the leg portion, and each component is stored into the decoration structure.

* * * * *